US009004870B2

(12) United States Patent
Calza et al.

(10) Patent No.: US 9,004,870 B2
(45) Date of Patent: Apr. 14, 2015

(54) ROTOR FOR TURBOMACHINES WITH SHROUDED BLADES

(75) Inventors: Paolo Calza, Rivalta di Torino (IT); Rosario Grillo, Rivalta di Torino (IT); Sergio Salvano, Turin (IT)

(73) Assignee: AVIO S.p.A., Turin (IT)

( * ) Notice: Subject to any disclaimer, the term of this patent is extended or adjusted under 35 U.S.C. 154(b) by 699 days.

(21) Appl. No.: 13/255,701

(22) PCT Filed: Mar. 9, 2009

(86) PCT No.: PCT/IT2009/000086

§ 371 (c)(1),
(2), (4) Date: Dec. 27, 2011

(87) PCT Pub. No.: WO2010/103552

PCT Pub. Date: Sep. 16, 2010

(65) Prior Publication Data

US 2012/0087794 A1 Apr. 12, 2012

(51) Int. Cl.
*F01D 5/26* (2006.01)
*F01D 5/22* (2006.01)

(52) U.S. Cl.
CPC ..... *F01D 5/225* (2013.01); *F05D 2260/96* (2013.01)

(58) Field of Classification Search
CPC ..... F01D 5/22; F01D 5/225; F01D 5/03; F01D 5/027; F01D 11/006; Y10S 416/50
USPC ..... 416/190, 194, 196 R, 144, 145, 500, 416/179, 189, 191, 195; 415/119
See application file for complete search history.

(56) References Cited

U.S. PATENT DOCUMENTS

| | | | | |
|---|---|---|---|---|
| 2,610,823 A | | 9/1952 | Knowlton, Jr. | |
| 5,011,374 A | | 4/1991 | Miller | |
| 5,281,097 A | * | 1/1994 | Wilson et al. | 416/193 A |
| 5,522,705 A | | 6/1996 | Elaini et al. | |

FOREIGN PATENT DOCUMENTS

| | | |
|---|---|---|
| EP | 1605134 | 12/2005 |
| EP | 1635037 | 3/2006 |
| WO | WO 2008/030324 | 3/2008 |
| WO | WO 2010/103552 | 9/2010 |

OTHER PUBLICATIONS

International Search Report and Written Opinion in PCT Appln. No. PCT/IT2009/000086 mailed Jul. 7, 2010.

* cited by examiner

*Primary Examiner* — Nathaniel Wiehe
*Assistant Examiner* — Eldon Brockman
(74) *Attorney, Agent, or Firm* — David Berquist Jackson & Gowdey LLP

(57) ABSTRACT

A rotor for turbomachines with shrouded blades comprising a row of a plurality of blades covered by an external ring, coaxial to said row of blades; the external ring being composed of a plurality of sectors, commonly referred to as shrouds, which are adjacent to one another and transversely and circumferentially attached to the end of respective blades; a damping member being arranged so as to straddle a respective pair of adjacent sectors and being pushed, in use, against radially internal surfaces of the sectors of the pair of adjacent sectors.

19 Claims, 3 Drawing Sheets

ROTOR FOR TURBOMACHINES WITH SHROUDED BLADES

TECHNICAL FIELD

The present invention relates to a rotor for turbomachines with shrouded blades, said rotor being of the type comprising a blade row and an external ring comprising a plurality of sectors, commonly referred to as shrouds, each of which is fixed to the free end of a respective blade and is separated from each adjacent sector by an air gap.

BACKGROUND ART

It is known that, in use, the blades of a rotor of this type are subject to vibratory motion generated both by the impulsive forces applied thereto, and by any unbalance of the blade row, and that the vibrations of the blades can be sufficient to cause repeated collisions or scraping of each sector of the external ring with the adjacent sectors and that the scraping can relatively quickly cause said external ring to become worn.

DISCLOSURE OF INVENTION

The object of the present invention is to provide a rotor for a turbomachine with shrouded blades, which reduces or eliminates the vibrations and the associated inconveniences described above.

According to the present invention there is provided a rotor for turbomachines with shrouded blades according to what is described herein.

BRIEF DESCRIPTION OF THE DRAWINGS

The present invention will now be described with reference to the accompanying drawings, illustrating a non-limiting embodiment thereof, in which.

BEST MODE FOR CARRYING OUT THE INVENTION

Figure 1:
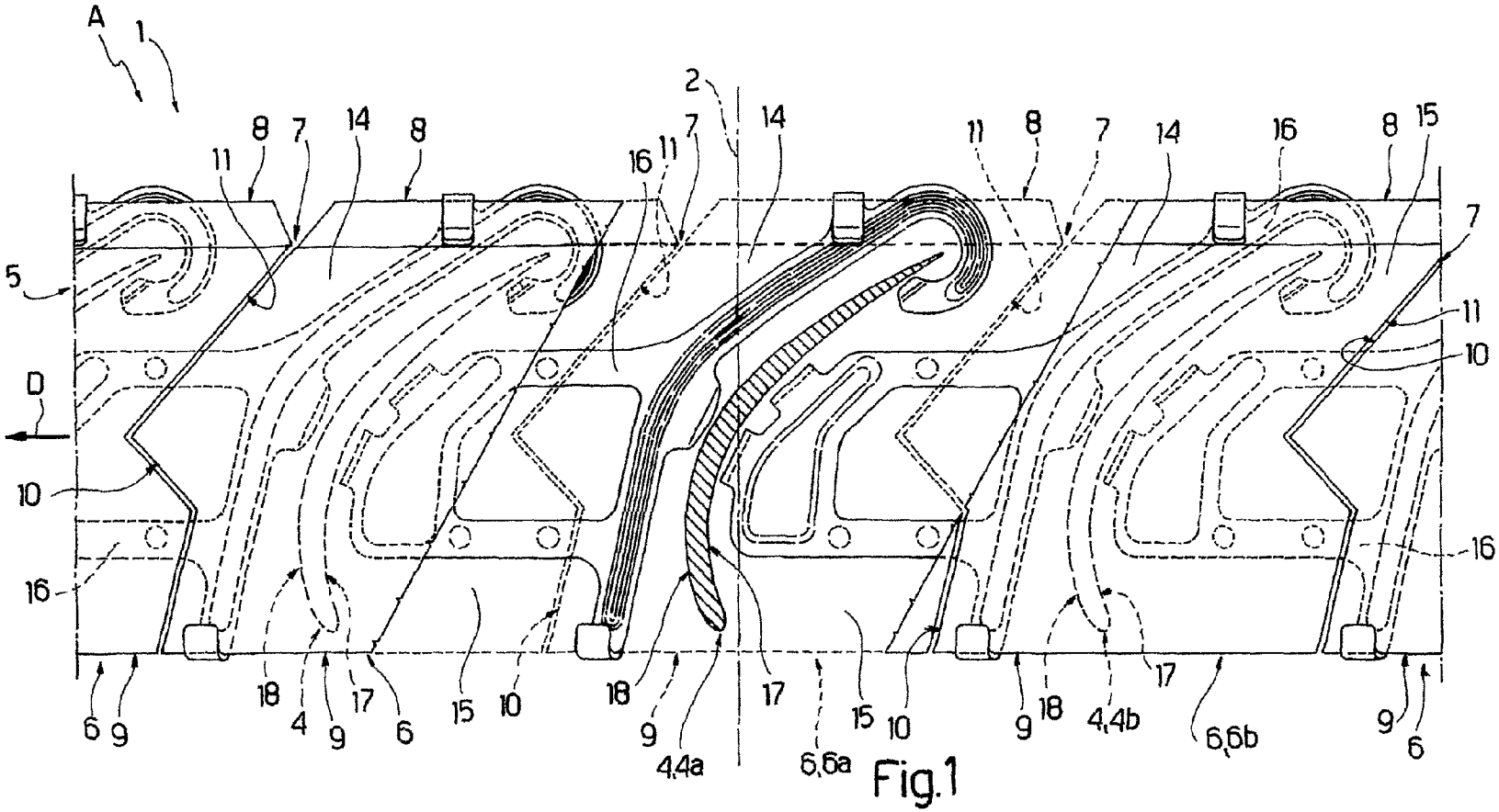
FIG. 1 is a partially cross-sectional plan view of a partial plane development of a preferred embodiment of the rotor according to the present invention.
Figure 2:
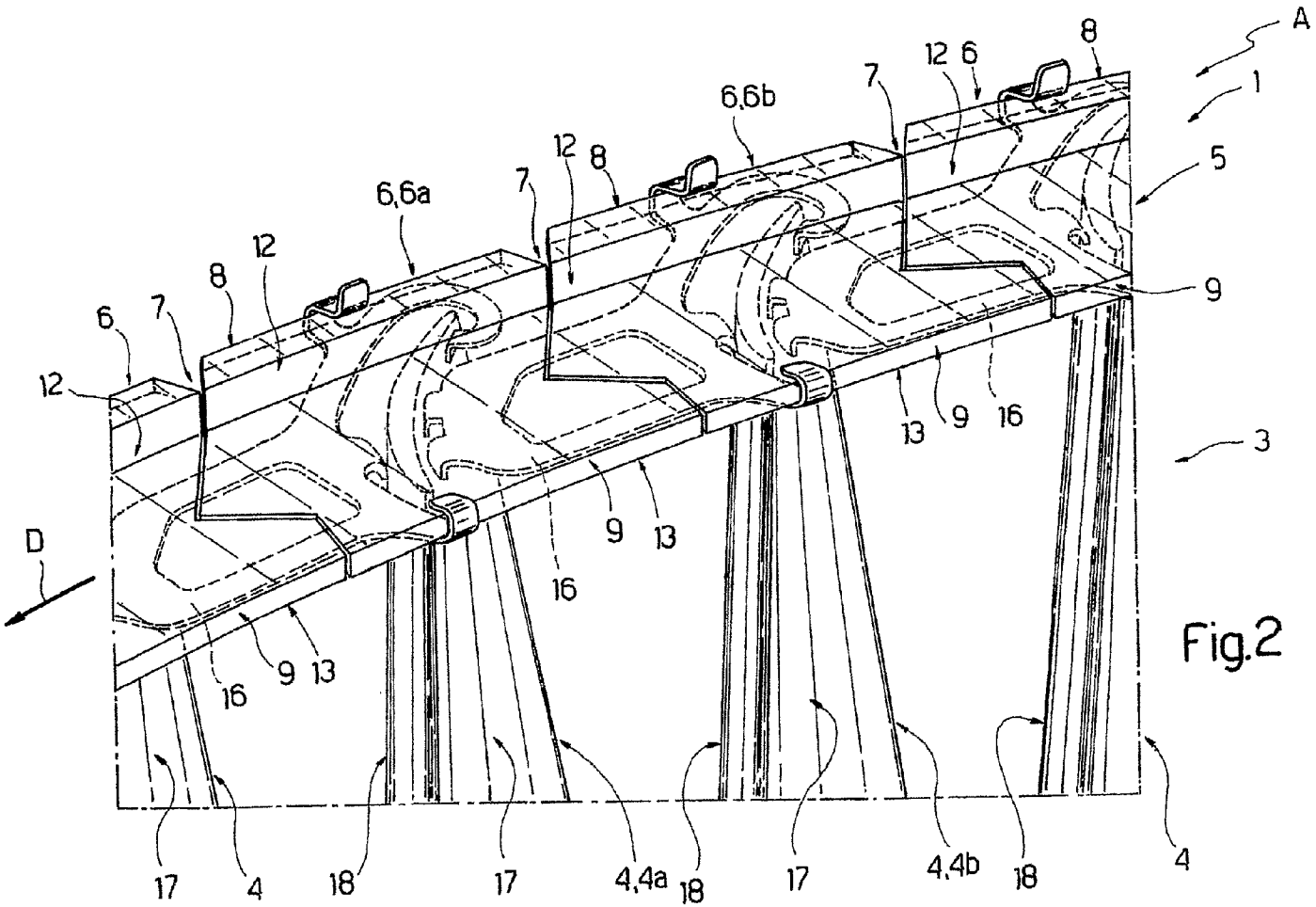
FIG. 2 is a perspective view of the portion of rotor of FIG. 1.
Figure 4:
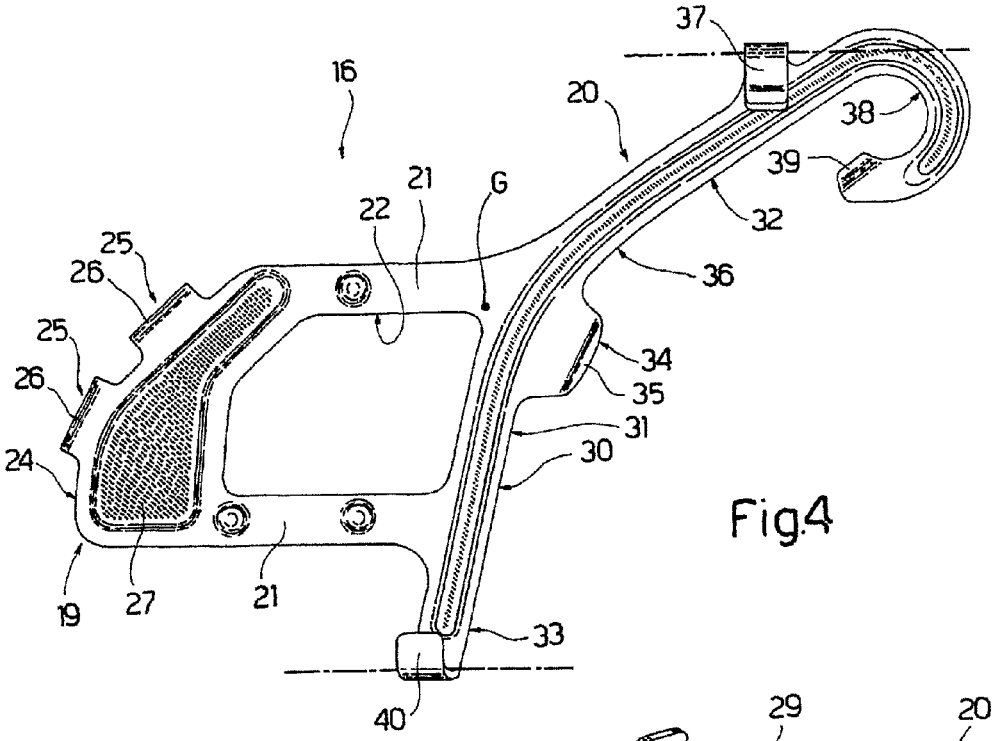
FIG. 4 is a plan view of the detail of FIG. 3.

In FIGS. 1 and 2, designated as a whole by number 1 is a rotor of a turbomachine A. The rotor 1 is mounted so as to rotate about an axis 2 in a direction D and comprises at least one row 3 of blades 4 coaxial to the axis 2; and at least one external ring 5, which covers the row 3 and is coaxial to the axis 2. The external ring 5 consists of a plurality of sectors 6, commonly referred to as shrouds, each of which is separated from each of the adjacent sectors 6 by means of a relative air gap 7 and is fixed to the free end of a respective blade 4.

Each sector 6 is defined by a substantially flat plate, the lateral edges of which are defined by two flat circumferential surfaces 8 and 9 that are substantially in a same plane and parallel to one another, and by a generally convex front transverse surface 10 (in relation to the direction D) and by a generally concave rear transverse surface 11 that are complementary with respect to one another. In particular, the front transverse surface 10 of a sector 6 is coupled to the rear transverse surface 11 of an adjacent sector 6 with the interposition of the respective air gap 7 the width of which is substantially constant.

According to a first embodiment (not illustrated) the width of the air gap 7 is variable; preferably, thus, the front transverse surface 10 could at least partially come into contact with the rear transverse surface 11.

According to another alternative embodiment (not illustrated) the transverse surfaces 10 and 11 can be chosen from among a group of pairs of surfaces with different geometries; moreover, the air gaps 7 of an external ring 5 can be of different widths.

Each sector 6 is also provided with a radially external surface 12 and a radially internal surface 13 which are substantially level and substantially parallel to one another. In particular, the radially internal surface 13 is divided into a front portion 14 and a rear portion 15 by the free end of the relative blade 4.

The rotor 1 also comprises a plurality of damping members 16, each of which is arranged so as to straddle a respective pair of sectors 6.

For the sake of simplicity, the following description refers to a single pair of adjacent sectors 6, straddled by a relative damping member 16; and the terms front and rear are used, as previously, in relation to the direction D. Moreover, according to that illustrated in FIG. 2, in the pair of sectors 6 considered here, the sector 6 arranged to the front and the elements integrally connected thereto are indicated by the index letter "a", while the sector 6 arranged to the rear and the elements integrally connected thereto are indicated by the index letter "b".

The damping member 16 is defined by a substantially flat plate arranged so as to be in contact with the rear portion 15 of the radially internal surface 13 of the sector **6*a* and with the front portion 14 of the radially internal surface 13 of the sector 6*b*. Moreover, as will be described more fully later on in this document, a front end of the damping member 16 is arranged substantially so as to be in contact with a concave rear profile 17 of the blade 4*a* supporting the sector 6*a*, while a rear end of the damping member 16 is arranged substantially so as to be in contact with a convex front profile 18 of the blade 4*b* supporting the sector 6*b***.

Figure 3:
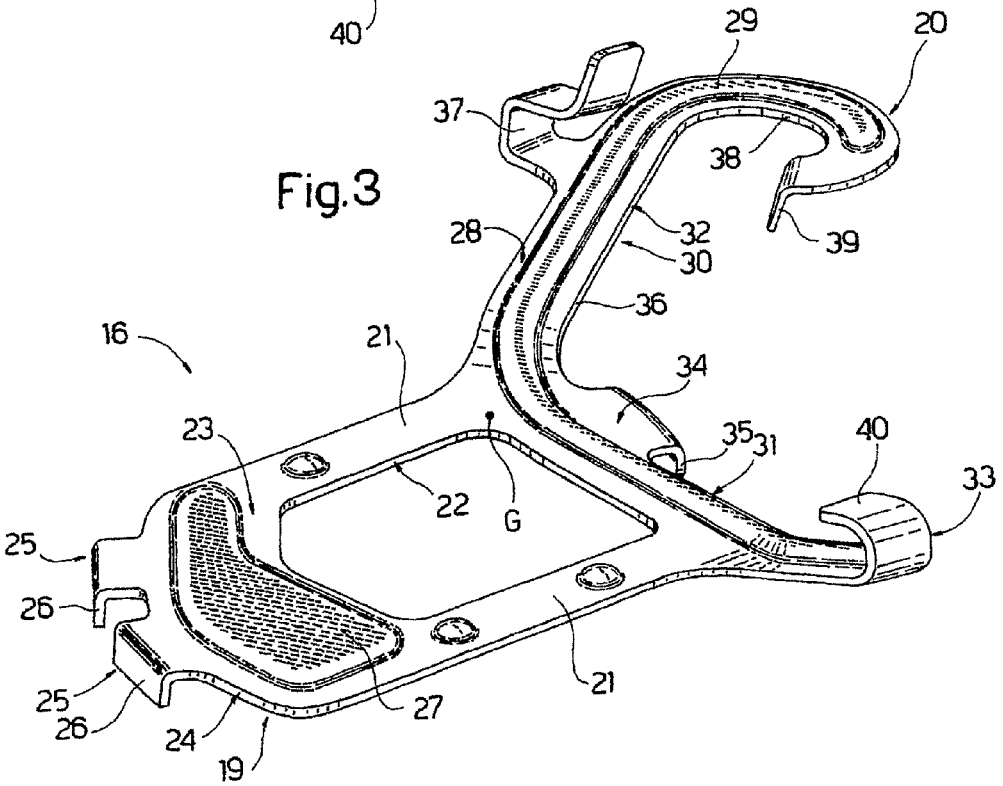
FIG. 3 is a perspective view on an enlarged scale of a detail of FIGS. 1 and 2.

According to that illustrated in FIG. 3, each damping member 16 comprises a front strip 19 and a rear strip 20 that are substantially transversal with respect to the direction D. In particular, the front strip 19 is connected to an intermediate section of the rear strip 20 by means of two strips 21, which extend from respective ends of the front strip 19, are substantially parallel to the direction D and delimit, with the front 19 and rear 20 strips, an aperture 22.

The front strip 19 has a radially external surface 23 and is limited anteriorly by an edge 24 substantially parallel to the concave rear profile 17 of the blade **4*a*. Two appendices 25 protrude forwards from the edge 24 and are bent inwards at a right-angle so as to define two radial tabs 26, arranged substantially so as to be in contact with the concave rear profile 17 of the blade 4*a*; while a boss 27 protrudes radially outwards from a central portion of the radially external surface 23 in a position facing and in contact with the rear portion 15 of the sector 6*a***.

The rear strip 20 has a radially external surface 28 that is in the same plane as the radially external surface 23 of the front strip 19 and is provided with a boss 29, which extends substantially along the entire length of the rear strip 20 and protrudes radially outwards from the radially external surface 28 in a position facing and in contact with the front portion 14 of the sector **6*b*. The rear strip 20 is limited posteriorly by an edge 30 substantially parallel to the convex front profile 18 of the blade. 4***b* and comprises a central portion 31 arranged between the strips 21 and two end portions 32 and 33 extending from the opposite ends of the central portion 31.

The central portion 31 is provided centrally with an appendix 34, which protrudes backwards from the edge 30 and is bent inwards at a right-angle in order to define a radial tab 35, which is arranged substantially so as to be in contact with the convex front profile 18 of the blade 4*b*.

The end portion 32 comprises an initial section 36, which is connected to the central portion 31, is substantially straight, extends along the convex front profile 18 of the blade 4*b* and is provided with an appendix 37, which extends from an edge of the initial section 36 opposite the edge 30 and is bent in a U-shape and in a radially outward direction in order to laterally couple with the sector 6*b* straddling the relative flat circumferential surface 8. The end portion 32 also comprises an end section 38, which is bent in a U-shape in order to laterally embrace the blade 4*b* and terminates with a tab 39, which is bent at a right-angle in a radially inward direction and is arranged substantially so as to be in contact with the concave rear profile 17 of the blade 4*b*.

The end portion 33 has a terminal appendix 40, which is bent in a U-shape and in a radially outward direction in order to laterally couple with the sector 6*b* straddling the relative flat circumferential surface 9.

In connection with the above description it should be stated that the dampers 16, according to a further embodiment (not illustrated), can be provided with more than one aperture 22, and that, by varying certain parameters such as the shape and/or the dimensions and/or the position and/or the number of the apertures 22 it is possible to vary the weight and the position of the centre of gravity G of each damping member 16; while, by varying other parameters such as the number, the geometry and the size of the bosses 27 and 29, it is possible to vary the interfering action between each damping member 16 and the external ring 5. Moreover, the bosses 27 and 29 facilitate the stiffening of the damper 16 without increasing its weight.

Ultimately, by choosing each damping member 16 from among a set of damping members 16 that differ from one another in terms of the values of one or more of the aforesaid parameters, it is possible to produce a rotor 1, which substantially behaves in exactly the same way as that in the theoretical design.

The damping member 16 is made by means of a moulding process from a flat metal sheet, preferably made of HASTELLOY-X or HAYNES-188, and the bosses 27 and 29 can be coated with anti-wear material; alternatively, the damping member 16 is made of an anti-wear material.

In use, during the rotation of the rotor 1, each damping member 16 is pushed due to the centrifugal force against the radially internal surface 13 of the external ring 5 and the amount of frictional force that is generated, the number of turns being equal, depends on the weight and the geometry of said damping member 16. Generally speaking, the damping effect of the damping members 16 can be adjusted by varying the weight and the position of the centre of gravity of said damping members 16, each of which can be chosen, as described above and according to the specific requirements, from among a plurality of damping members 16 that differ from one another, in particular, in terms of their weight and the position of the centre of gravity.

It should be understood that the damping members 16 do not need to be assembled in specific seats or chambers in the rotor 1; instead, each damping member 16 can be inserted radially into the external ring 5 of an existing generic rotor 1 in order to dampen the vibrations that are effectively generated along the relative blades 4.

In some cases, the damping member 16 can also be inserted into a rotor 1 of a turbomachine A that has already been completely installed without the need for complex operations to disassemble/assemble said turbomachine A; for example, the damping members 16 can be inserted between the blades 4 of a last stage of a gas turbine already mounted on the wing of an aircraft.

The use of the damping members 16 is particularly advantageous in the presence of a turbomachine A with reactions that are different from those initially envisaged in the design plan; the damping members 16 are in fact capable of effectively reducing both the amplitude of the vibrations of the blades 4 and the related dissipative effects which cause significant wear, such as collisions between two adjacent sectors 6.

Lastly, the damping members 16 of a same rotor 1 need not all be identical, but can differ from one another and be used to balance the relative rotor 1.

The invention claimed is:

1. A rotor for turbomachines comprising a row of a plurality of blades and an external ring comprising a plurality of sectors adjacent to one another and each of which is fixed to the free end of a respective pair of adjacent blades; and a plurality of damping members coupled to the external ring to dampen the vibrations of the blades; each damping member being arranged radially inside the external ring between the blades of a respective pair of adjacent blades and having a radially external surface, which is arranged so as to be in contact with each one of adjacent sectors, fixed to the blades of the respective pair of adjacent blades, wherein the damping members are coupled to one of two adjacent sectors by forming the damping members with front and rear strips with the rear strip comprised of portions that extend generally along a length of the blade and have spaced apart coupling members adjacent opposing ends of the rear strip that respectively connect with a portion of opposite edges of the one adjacent sector.

2. The rotor according to claim 1, wherein the front and rear strips are substantially transversal with respect to the direction D of motion of the rotor and fixed to one another; the front and rear strips being arranged so as to be in contact with the front sector and, respectively, the rear sector of the two sectors fixed to the blades of the respective pair of adjacent blades.

3. The rotor according to claim 2, wherein the pair of adjacent blades includes a front blade and the front strip extends transversely with respect to the front blade of the respective pair of adjacent blades and along a concave rear profile of the front blade itself.

4. The rotor according to claim 2, wherein the rear adjacent blades include a rear blade, and the rear strip extends transversely with respect to the rear blade of the respective pair of adjacent blades and partially embraces said rear blade; the rear strip extending in part along a convex front profile and in part along a concave rear profile of the rear blade.

5. The rotor according to claim 1, wherein each damping member is provided with first and second contact members along a radially external surface, which adhere to a rear portion and, respectively, to a front portion of radially internal surfaces of the two sectors fixed to the blades of the respective pair of blades.

6. The rotor according to claim 5, wherein the first and the second contact members means comprise a first and, respectively, a second boss, which protrude radially outwards from the radially external surface of the damping member.

7. The rotor according to claim 5, wherein at least one of said first and second contact members is coated with an anti-wear material.

8. The rotor according to claim 1, wherein each coupling member is engaged with a circumferential surface of the external ring.

9. The rotor according to claim 8, wherein each coupling member engages the rear sector of the two sectors fixed to the blades of the respective pair of blades.

10. The rotor according to claim 1, wherein the damping member comprises radial tabs arranged substantially so as to be in contact in part with a rear profile of the front blade, in part with a convex front profile of the rear blade, and in part with a concave rear profile of the rear blade of the respective pair of blades.

11. The rotor according to claim 1, wherein each damping member comprises a plate provided with at least one aperture, and a centre of gravity; the position of the centre of gravity and the weight of the damping member being a function of the shape, of the position and of the dimensions of said aperture; and each damping member being chosen from among a plurality of damping members having apertures that are different from one another.

12. The rotor according to claim 1, wherein the damping members differ from one another and are chosen in order to dynamically balance said rotor.

13. The rotor according to claim 1, wherein at least one damping member is made of an anti-wear material.

14. The rotor according to claim 1, wherein each sector is separated, at least partially, from each adjacent sector by means of an air gap.

15. The rotor according to claim 14, wherein the air gaps are all of the same width.

16. The rotor according to claim 14, wherein the air gaps are all of different widths.

17. A damping system for a turbomachine comprised of a row of a plurality of blades and an external ring comprised of a plurality of adjacent, spread apart sectors, each of the plurality of sectors being fixed to a free end of one of the plurality of blades, the damping system comprising a plurality of damping members each being arranged so as to be in contact with each adjacent sector and connected to portions of one of the adjacent sectors, the plurality of damping members being arranged radially inside the external ring and between two adjacent blades along the row of the plurality of blades, and having one portion on one side of the damping member in contact with a convex front profile of one of the plurality of blades and another portion on an opposing side of the damping member in contact with a concave rear portion of an adjacent blade among the plurality of blades.

18. A rotor for turbomachines comprising a row of a plurality of blades and an external ring comprising a plurality of sectors adjacent to one another and each of which is fixed to the free end of a respective pair of adjacent blades; and a plurality of damping members coupled to the external ring to dampen the vibrations of the blades; each damping member being arranged radially inside the external ring between the blades of a respective pair of adjacent blades and having a radially external surface, which is arranged so as to be in contact with each one of adjacent sectors, fixed to the blades of the respective pair of adjacent blades; wherein each damping member comprises a front strip and a rear strip that are substantially transversal with respect to the direction D of motion of the rotor and fixed to one another; the front and rear strips being arranged so as to be in contact with the front sector and, respectively, the rear sector of the two sectors fixed to the blades of the respective pair of adjacent blades; and wherein the rear adjacent blades include a rear blade, and the rear strip extends transversely with respect to the rear blade of the respective pair of adjacent blades and partially embraces said rear blade; the rear strip extending in part along a convex front profile and in part along a concave rear profile of the rear blade.

19. A rotor for turbomachines comprising a row of a plurality of blades and an external ring comprising a plurality of sectors adjacent to one another and each of which is fixed to the free end of a respective pair of adjacent blades; and a plurality of damping members coupled to the external ring to dampen the vibrations of the blades; each damping member being arranged radially inside the external ring between the blades of a respective pair of adjacent blades and having a radially external surface, which is arranged so as to be in contact with each one of adjacent sectors, fixed to the blades of the respective pair of adjacent blades; wherein the damping member comprises radial tabs arranged substantially so as to be in contact in part with a rear profile of the front blade, in part with a convex front profile of the rear blade, and in part with a concave rear profile of the rear blade of the respective pair of blades.

* * * * *